US007699643B1

(12) United States Patent
Rodriquez

(10) Patent No.: US 7,699,643 B1
(45) Date of Patent: Apr. 20, 2010

(54) ELECTRICAL CORD MANAGEMENT DEVICE

(76) Inventor: Vincent J. Rodriquez, 139 Gramatan Dr., Yonkers, NY (US) 10701

( * ) Notice: Subject to any disclaimer, the term of this patent is extended or adjusted under 35 U.S.C. 154(b) by 0 days.

(21) Appl. No.: 12/365,462

(22) Filed: Feb. 4, 2009

(51) Int. Cl.
*H01R 13/62* (2006.01)

(52) U.S. Cl. ..... 439/369

(58) Field of Classification Search ..... 439/369, 439/370, 371, 501, 502
See application file for complete search history.

(56) References Cited

U.S. PATENT DOCUMENTS 4,183,603 A 1/1980 Donarummo
4,773,874 A * 9/1988 Kopeski, Jr. ..... 439/369
5,573,420 A 11/1996 Grosswendt
5,582,524 A * 12/1996 Sanner et al. ..... 439/369
6,135,803 A * 10/2000 Kovacik et al. ..... 439/369
D466,088 S 11/2002 Saben
D474,156 S 5/2003 Vournou
7,528,323 B2 * 5/2009 Wu et al. ..... 174/66

* cited by examiner

*Primary Examiner*—Chandrika Prasad
(74) *Attorney, Agent, or Firm*—Dale J. Ream

(57) ABSTRACT

An electrical cord management device includes an elongate housing having open first and second ends, an open side, and an open interior area extending between the open ends and open side. A first friction fit clip is positioned in the open interior area and coupled to the housing for attachment to a first electrical cord. A second friction fit clip is positioned in the open interior area and coupled to the housing for attachment to a second electrical cord. The first and second clips are sufficiently spaced apart to allow an end of the first electrical cord to be coupled to an end of the second electrical cord while the first electrical cord is coupled to the first friction fit clip and the second electrical cord is coupled to the second friction fit clip. A lanyard is positioned adjacent the housing first end.

20 Claims, 6 Drawing Sheets

ELECTRICAL CORD MANAGEMENT DEVICE

BACKGROUND OF THE INVENTION

The present invention relates generally to securing devices and, more particularly, to an electrical cord management device for selectively securing respective ends of two electrical cords in an engaged configuration.

Extension cords provide a desirable convenience in that they enable many electrical devices to be electrically energized even when situated far from an electrical outlet. For example, extension cords allow use of electrical items such as a televisions, lamps, or even tools such as drills, table saws, or the like in home or outdoor environments. Although providing great utility, extension cords may become burdensome when the ends of two cords repeatedly become unintentionally unplugged, the cords become tangled, or a cord becomes snagged on another object.

Various devices have been proposed for securing respective ends of a pair of electrical cords together. Although assumably effective for their intended purposes, the existing devices and patent proposals do not adequately shield and guard the cord ends from becoming snagged on other objects as they slide across a floor or ground surface. Further, the existing devices are incapable of securing a cord to the shielding device even while intentionally disconnected from another electrical cord.

Therefore, it would be desirable to have an electrical cord management device that secures respective ends of two cables while engaged. Further, it would be desirable to have an electrical cord management device that enables two electrical cords to slide across a floor or the ground without becoming snagged or entangled. In addition, it would be desirable to have an electrical cord management system that includes a lanyard for storing an extension cord when not in use.

SUMMARY OF THE INVENTION

An electrical cord management device according to the present invention includes an elongate housing having open first and second ends, an open side, and an open interior area extending between the open ends and open side. A first friction fit clip is positioned in the open interior area and coupled to the housing for attachment to a first electrical cord. A second friction fit clip is positioned in the open interior area and coupled to the housing for attachment to a second electrical cord. The first and second clips are sufficiently spaced apart to allow an end of the first electrical cord to be coupled to an end of the second electrical cord while the first electrical cord is coupled to the first friction fit clip and the second electrical cord is coupled to the second friction fit clip. A lanyard is positioned adjacent the housing first end.

Therefore, a general object of this invention is to provide an electrical cord management device for maintaining the connection of two electrical cords.

Another object of this invention is to provide an electrical cord management device, as aforesaid, that enables connected cords to slide across a floor or ground surface without becoming entangled, snagged, or disconnected.

Still another object of this invention is to provide an electrical cord management device, as aforesaid, that can selectively store an electrical cord when not in use.

Yet another object of this invention is to provide an electrical cord management device, as aforesaid, that is easy to use and economical to produce.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

An electrical cord management device will now be described in detail with reference to FIG. 1 through FIG. 5 of the accompanying drawings. More particularly, an electrical cord management device 100 includes an elongate housing 110.

Figure 1:
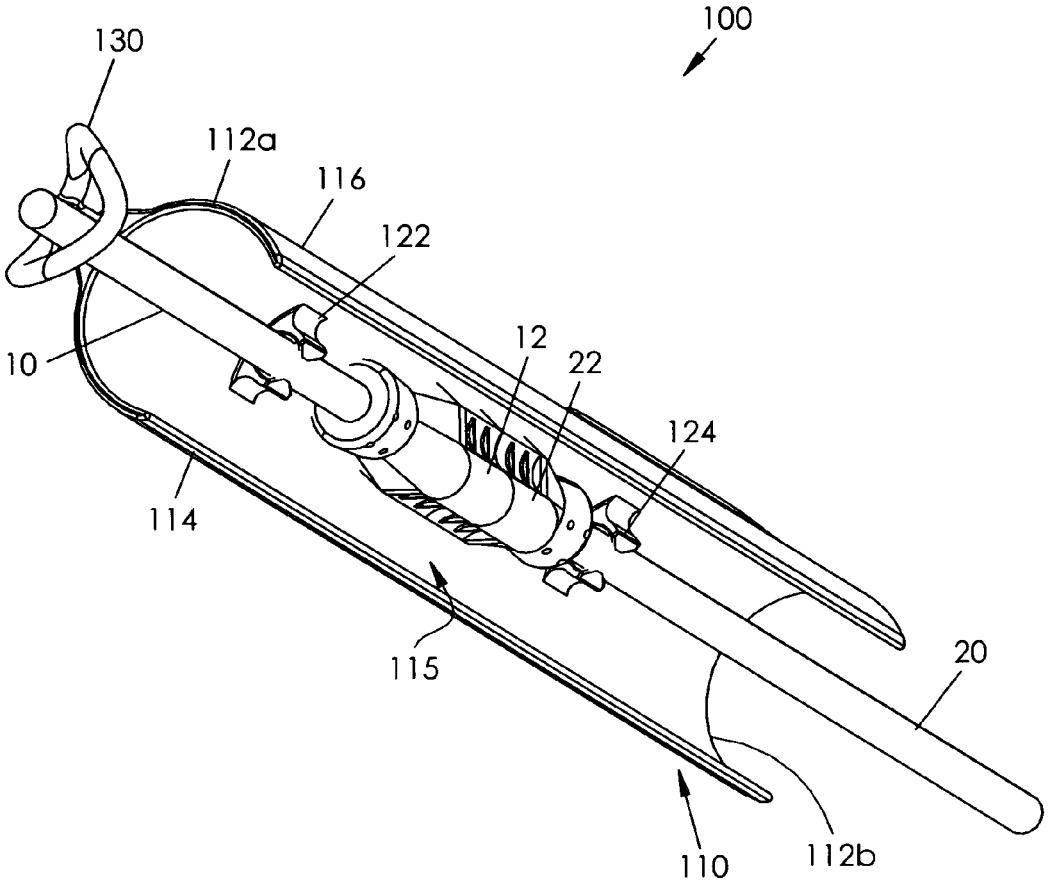
FIG. 1 is a perspective view of an electrical cord management system according to a preferred embodiment of the present invention.
Figure 4:
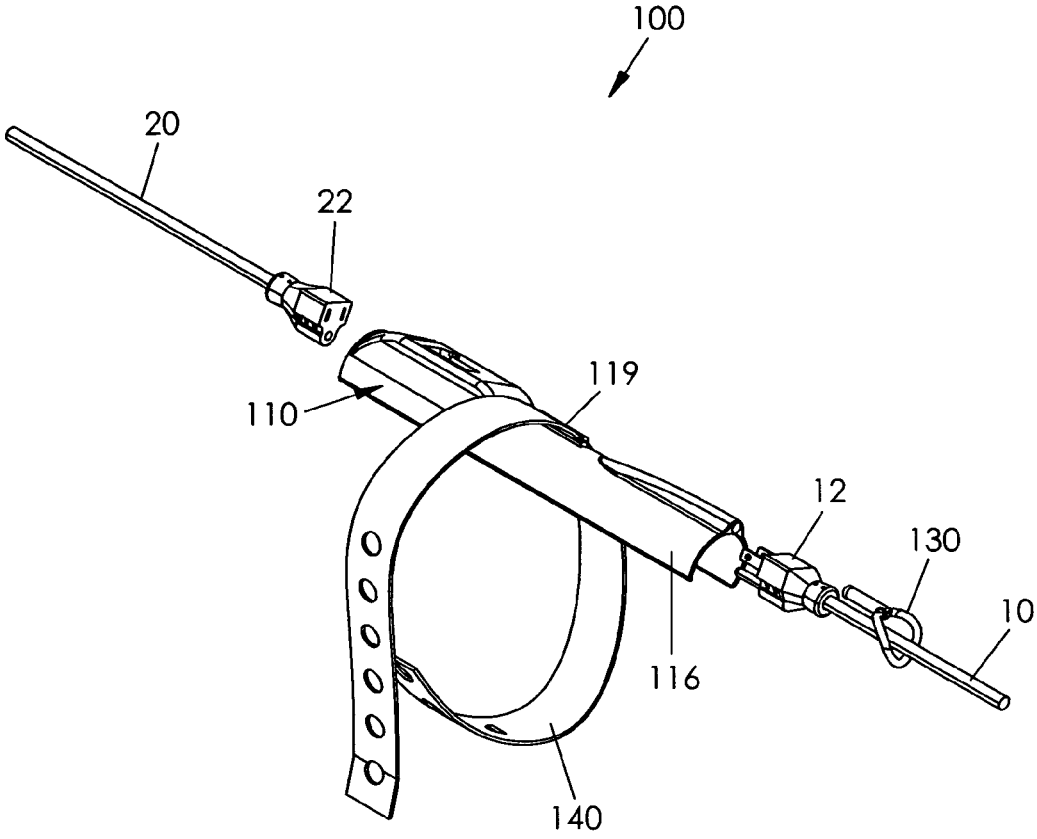
FIG. 4 is another perspective view of the electrical cord management system as in FIG. 1 from another angle and in use with an adjustable strap.
Figure 5:
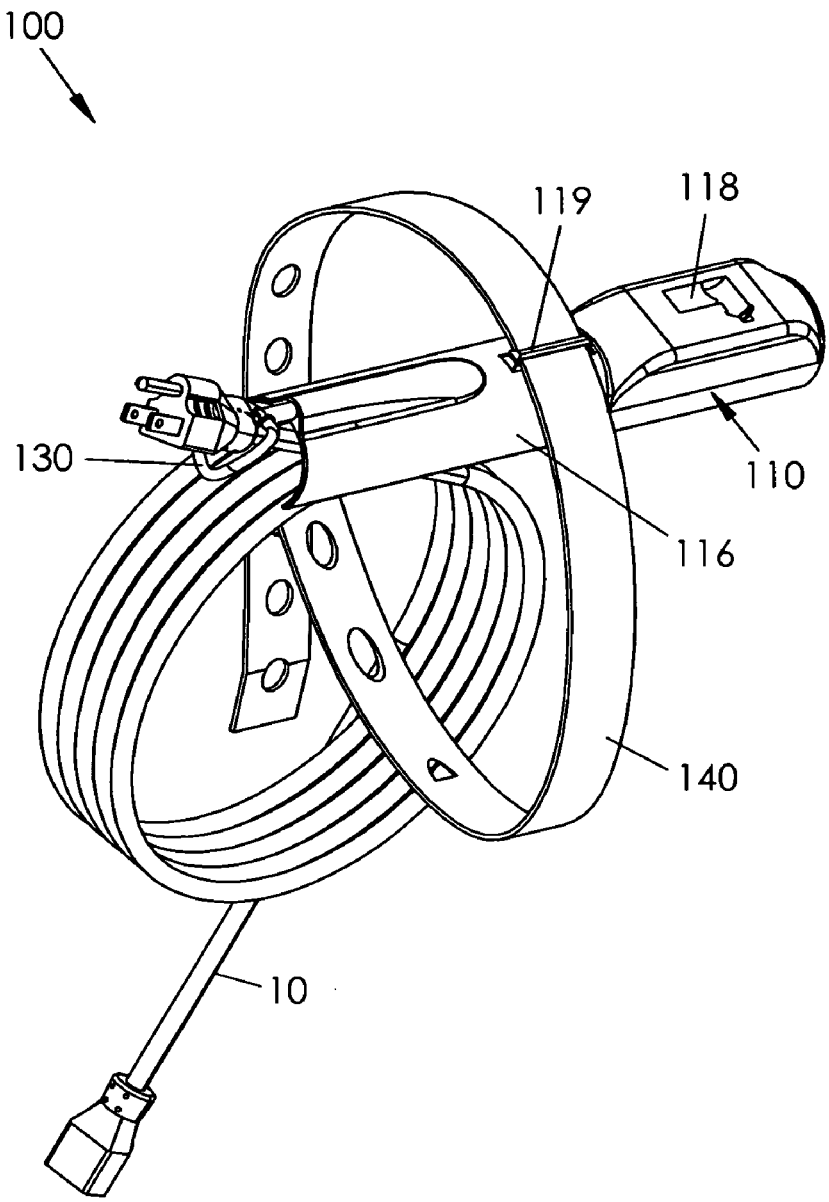
FIG. 5 is another perspective view of the electrical cord management system as in FIG. 1 from another angle and in use with an adjustable strap and extension cord.

As shown in FIG. 1, the elongate housing 110 has an open first end 112*a* for receiving a first electrical cord 10 and an open second end 112*b* for receiving a second electrical cord 20. The housing 110 has an open side 114 and defines an open interior area 115 that extends between the first and second ends 112*a*, 112*b* and the open side 114. In some embodiments, the housing 110 has a generally frusto-cylindrical outer surface 116 (FIGS. 1 and 4). It may be desirable for the outer surface 116 to extend more than one hundred and eighty degrees, and even more desirably more than two hundred and ten degrees, about a center point when viewed from the first or second end 112*a*, 112*b* or a cross section. As shown in FIG. 5, the housing 110 may include a tool receptor 118. The tool receptor 118 may be configured to receive various tools, such as drill chucks (as shown), driver bits, and drill bits, for example.

Figure 2:
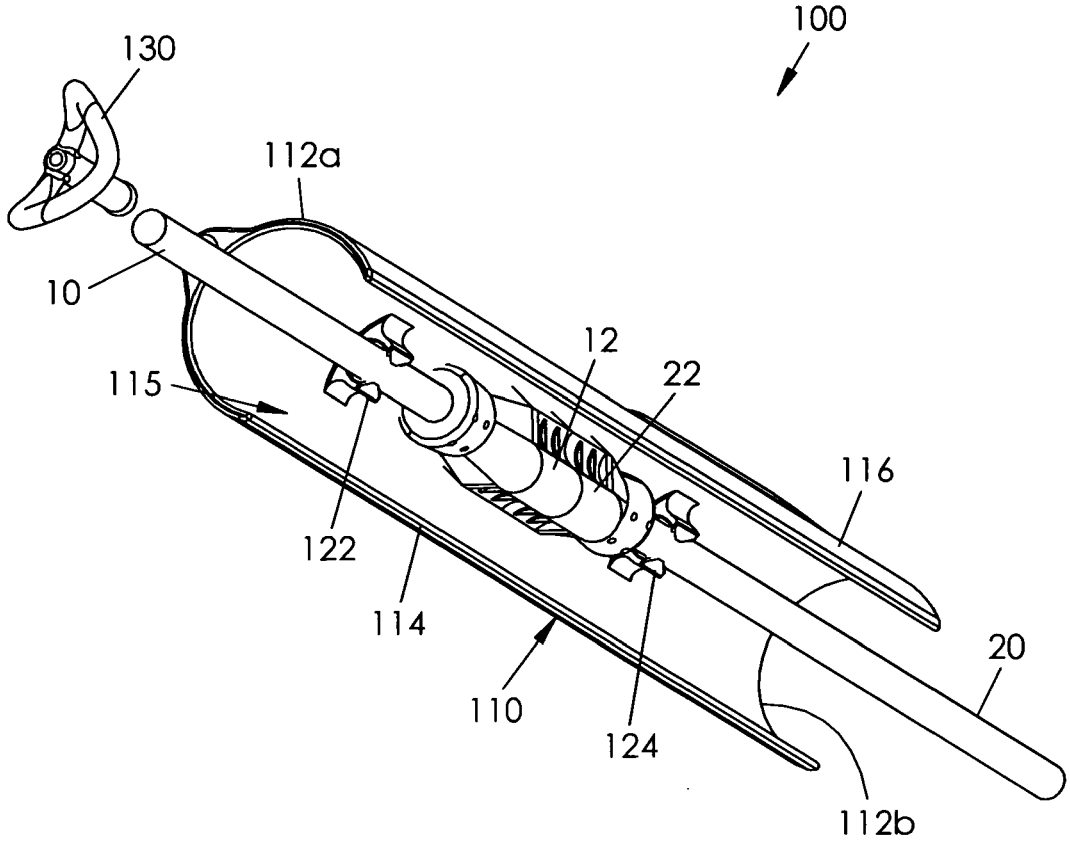
FIG. 2 is another perspective view of the electrical cord management system as in FIG. 1 with the lanyard detached from the housing.
Figure 3:
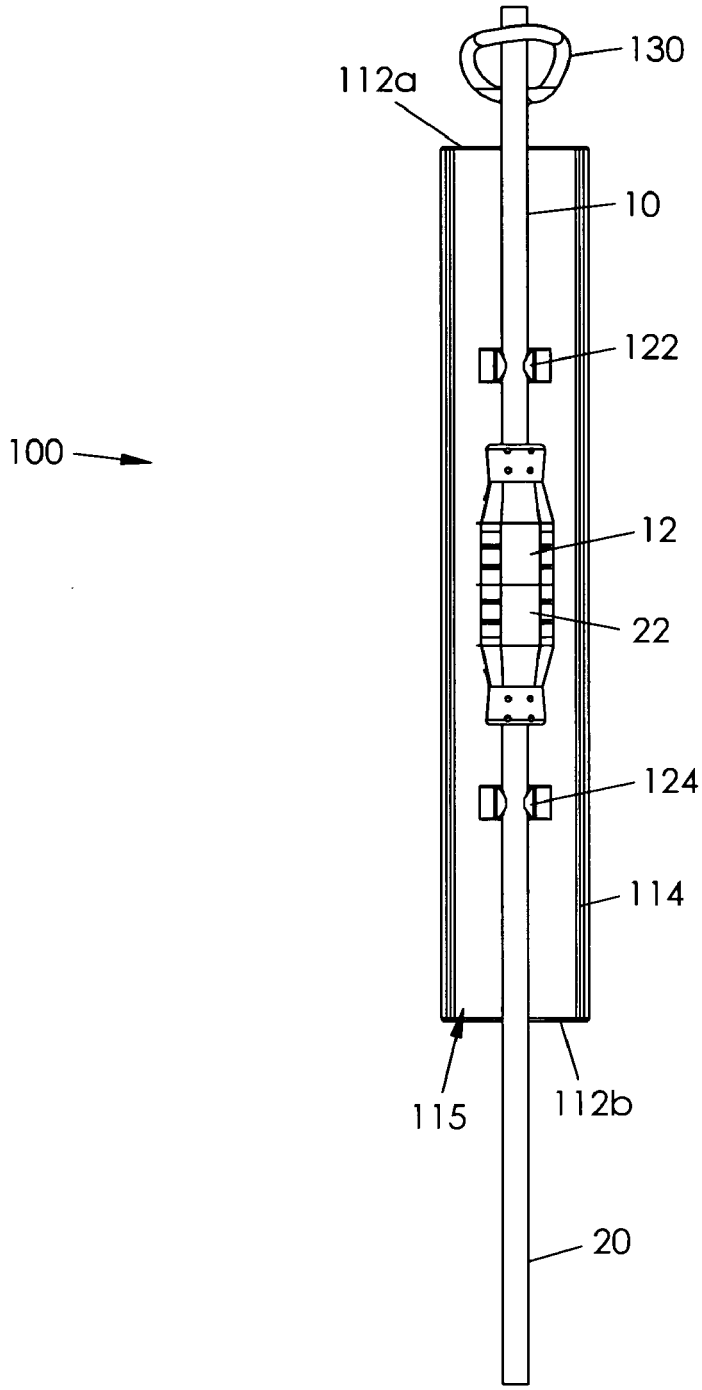
FIG. 3 is a top view of the electrical cord management system as in FIG. 1.

A first friction fit clip 122 is positioned in the open interior area 115 and coupled to (e.g., adhered to, fastened to, formed unitary with, etc.) the housing 110 for attachment to the first electrical cord 10, and a second friction fit clip 124 is positioned in the open interior area 115 and coupled to (e.g., adhered to, fastened to, formed unitary with, etc.) the housing 110 for attachment to the second electrical cord 20 (FIGS. 1 through 3). The first and second friction fit clips 122, 124 are sufficiently spaced apart to allow electrical communication between the first and second electrical cords 10, 20 while the first electrical cord 10 is coupled to the first friction fit clip 122 and the second electrical cord 20 is coupled to the second friction fit clip 124. In some embodiments, as shown in FIGS. 1 through 3, an end 12 of the first electrical cord 10 may be coupled to an end 22 of the second electrical cord 20 while the cords 10, 20 are coupled to the clips 122, 124.

A lanyard 130 is adjacent the housing first end 112*a* and may be permanently or removably coupled to the housing 110. The lanyard 130 may be configured to encircle the first electrical cord 10 and to allow the end 12 of the first electrical cord 10 to pass through. In some embodiments, the lanyard 130 is elastic and must be deformed to pass the first electrical cord end 12 through. In other embodiments, the lanyard 130 has an adjustable (though not deformable) diameter to allow the first electrical cord 12 to pass through.

As shown in FIGS. 4 and 5, an adjustable strap 140 may be coupled to the housing 110 for storing the first and/or second electrical cord 10, 20. The strap 140 is shown encircling the housing 110 and passing through a clip 119 on the outer surface 116. The strap 140 may be constructed of any appropriate material, (e.g., plastic, leather, etc.).

In use, the first cord 10 (e.g., beginning at the end 12) may be passed through the lanyard 130 as discussed above, in effect loosely coupling the first cord 10 to the housing 110. This loose coupling may allow the user to more easily couple the first and second cords 10, 20 together while maintaining control of the housing 110. Once the first and second cords 10, 20 are in electrical communication, the first cord 10 may be passed through the open side 114 and inserted in the first friction fit clip 122 in the interior area 115, and the second cord 20 may be passed through the open side 114 and inserted in the second friction fit clip 124 in the interior area 115, as shown in FIGS. 1 and 3. The user may then place the device 100 on the ground, and pulling one of the cords 10, 20 may cause the other cord 10, 20 to move and maintain electrical communication between the cords 10, 20. The shape of the outer surface 116 may allow the device 100 to move without being caught on (i.e., accidentally wedged or otherwise joined to) ambient objects, and the user may retrieve and store tool(s) in the tool receptor 118. As shown in FIG. 5, the user may wind the cord 10 and/or the cord 20 and use the strap 140 to maintain the wound configuration for storage or simply keeping the cord 10 and/or the cord 20 in an orderly manner during use. The lanyard 130 may further be used as a hook for storing or positioning the device 100.

Another embodiment of an electrical cord management device 200 according to the present invention will now be described in detail with reference to FIG. 6 of the accompanying drawings. The device 200 may include the elements and features discussed above, and common elements/features may be referred to herein and in the drawings by the same reference numbers set forth above and in FIGS. 1 through 5.

Figure 6:
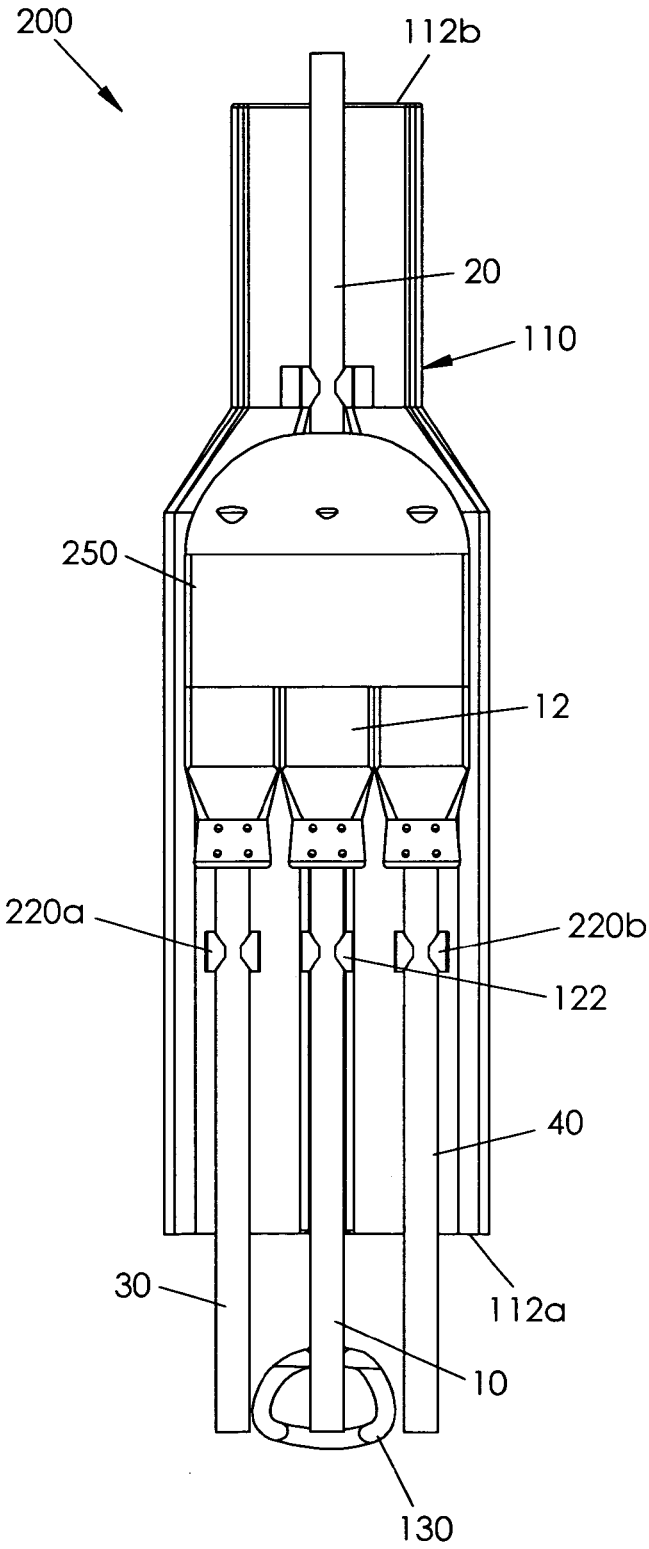
FIG. 6 is a top view on an enlarged scale showing an electrical cord management system according to another embodiment of the present invention.

As shown in FIG. 6, the device 200 includes a plug 250 in the housing 110 that the cords 10, 20 are coupled to for providing electrical communication, instead of coupling the cords 10, 20 (i.e., ends 12, 22) directly to one another. The plug 250 may allow additional cords to be placed in electrical communication, such as third and fourth electrical cords 30, 40 shown in FIG. 6. Further, additional friction fit clips 220*a*, 220*b* may be positioned in the interior area 115 and coupled to the housing 110 for attachment to the additional cords 30, 40. Use of the device 200 is similar to use of the device 100, though the additional cords 30, 40 may be accommodated.

It is understood that while certain forms of this invention have been illustrated and described, it is not limited thereto except insofar as such limitations are included in the following claims and allowable functional equivalents thereof.

The invention claimed is:

1. An electrical cord management device, comprising:

an elongate housing having open first and second ends, an open side, and an open interior area extending between said open first and second ends and said open side;

a first friction fit clip positioned in said open interior area and being coupled to said housing for attachment to a first electrical cord;

a second friction fit clip positioned in said open interior area and being coupled to said housing for attachment to a second electrical cord, said first and second friction fit clips being sufficiently spaced apart to allow an end of said first electrical cord to be coupled to an end of said second electrical cord while said first electrical cord is coupled to said first friction fit clip and said second electrical cord is coupled to said second friction fit clip; and a lanyard adjacent said housing first end.

2. The device of claim 1, wherein said housing has a generally frusto-cylindrical outer surface.

3. The device of claim 2, wherein said lanyard is removably coupled to said housing.

4. The device of claim 3, further comprising an adjustable strap coupled to said housing for storing at least one of said first and second electrical cords.

5. The device of claim 4, wherein said strap encircles said housing.

6. The device of claim 5, wherein said housing includes a tool receptor.

7. The device of claim 1, further comprising an adjustable strap coupled to said housing for storing at least one of said first and second electrical cords.

8. The device of claim 1, wherein said lanyard is removably coupled to said housing.

9. The device of claim 8, wherein said housing includes a tool receptor.

10. An electrical cord management device, comprising:

an elongate housing having a first end for receiving a first electrical cord, a second end for receiving a second electrical cord, an open side, and an open interior area extending between said first and second ends and said open side;

a first friction fit clip positioned in said open interior area and being coupled to said housing for attachment to said first electrical cord;

a second friction fit clip positioned in said open interior area and being coupled to said housing for attachment to said second electrical cord, said first and second friction fit clips being sufficiently spaced apart to allow electrical communication between said first and second electrical cords while said first electrical cord is coupled to said first friction fit clip and said second electrical cord is coupled to said second friction fit clip; and a lanyard adjacent said housing first end.

11. The device of claim 10, further comprising a plug in said housing to electrically couple said first and second electrical cords.

12. The device of claim 11, further comprising a third friction fit clip positioned in said open interior area and being coupled to said housing for attachment to a third electrical cord, wherein said plug is configured to electrically couple said first electrical cord and said third electrical cord to said second electrical cord.

13. The device of claim 12, further comprising an adjustable strap coupled to said housing for storing at least one of said first, second, and third electrical cords.

14. The device of claim 13, wherein said lanyard is removably coupled to said housing.

15. The device of claim 10, further comprising an adjustable strap coupled to said housing for storing at least one of said first, second, and third electrical cords.

16. The device of claim 10, wherein said lanyard is removably coupled to said housing.

17. The device of claim 10, wherein said housing has a generally frusto-cylindrical outer surface.

18. An electrical cord management device, comprising:

an elongate housing having a first end for receiving a first electrical cord, a second end for receiving a second electrical cord, an open side, and an open interior area extending between said first and second ends and said open side;

a first friction fit clip positioned in said open interior area and being coupled to said housing for attachment to said first electrical cord;

a second friction fit clip positioned in said open interior area and being coupled to said housing for attachment to said second electrical cord, said first and second friction fit clips being sufficiently spaced apart to allow electrical communication between said first and second electrical cords while said first electrical cord is coupled to said first friction fit clip and said second electrical cord is coupled to said second friction fit clip; and an adjustable strap coupled to said housing for storing at least one of said first and second electrical cords.

19. The device of claim 18, further comprising a lanyard coupled to said housing adjacent said housing first end.

20. The device of claim 18, wherein said housing includes a tool receptor.

* * * * *